US006881028B2

(12) United States Patent
Danielsson

(10) Patent No.: US 6,881,028 B2
(45) Date of Patent: Apr. 19, 2005

(54) PUMPING DEVICE

(75) Inventor: Peter Danielsson, Fagervik (SE)

(73) Assignee: Metso Paper, Inc. (FI)

( * ) Notice: Subject to any disclaimer, the term of this patent is extended or adjusted under 35 U.S.C. 154(b) by 0 days.

(21) Appl. No.: 10/472,282

(22) PCT Filed: Mar. 20, 2002

(86) PCT No.: PCT/SE02/00525

§ 371 (c)(1),
(2), (4) Date: Sep. 22, 2003

(87) PCT Pub. No.: WO02/075047

PCT Pub. Date: Sep. 26, 2002

(65) Prior Publication Data

US 2004/0091371 A1 May 13, 2004

(30) Foreign Application Priority Data

Mar. 21, 2001 (SE) ..... 0100996

(51) Int. Cl.[7] ..... F01D 25/32
(52) U.S. Cl. ..... 415/169.2; 415/126
(58) Field of Search ..... 415/126, 169.2, 415/169.1, 199.4–5, 220–1; 416/231 B

(56) References Cited

U.S. PATENT DOCUMENTS 5,017,198 A * 5/1991 Schieg et al. ..... 95/1
5,234,480 A * 8/1993 Henricson et al. ..... 95/243
6,290,760 B1 * 9/2001 Taivalkoski et al. ..... 96/195

* cited by examiner

*Primary Examiner*—Edward K. Look
*Assistant Examiner*—James M. McAleenan
(74) *Attorney, Agent, or Firm*—Lerner, David, Littenberg, Krumholz & Mentlik, LLP

(57) ABSTRACT

Apparatus for pumping a pulp suspension and simultaneous abduction of gas from the suspension is disclosed. The apparatus comprises at least one pulp pump including a pump housing with an inlet, a first outlet for the suspension, and a second outlet for the gas. The gas outlet is connected to at least one external vacuum pump by a gas conduit including a substantially vertical portion having a maximum height, located on a level above the pulp pump, and a flushing water supply for the supply of flushing water to the gas conduit connected above the substantially vertical portion of the gas conduit.

7 Claims, 1 Drawing Sheet

PUMPING DEVICE

FIELD OF THE INVENTION

The present invention relates to a device for pumping a pulp suspension and simultaneously abducting gas from the suspension. More particularly, the present invention relates to a pulp pump, which is connected to a vacuum pump for evacuating gas, such as air, from the pulp in the pump.

BACKGROUND OF THE INVENTION

In connection with pulp pumps, gas following along with the pulp causes problems during pumping therein, especially in centrifugal pumps. The gas in the pulp accumulates in the form of bubbles, which accumulate in front of the impeller and thereby deteriorates the capacity of the pump. This problem can be eliminated by evacuating the gas from the space in front of the impeller of the centrifugal pump to a sealing space behind the impeller and further out of the housing of the pulp pump, for example by means of vacuum pumps of the liquid ring type. These vacuum pumps are often separate pumps, the suction pipe of which is connected to the sealing space in the housing of the pulp pump. Alternatively, they can be designed as a separate vacuum impeller in the form of a liquid ring impeller located on the shaft of the pulp pump, so that common operation for both impellers is obtained. In the last mentioned case, however, the capacity of the vacuum pump is restricted for spatial reasons.

A system with an external vacuum pump comprises a pulp pump, which by a pipe is coupled to a vacuum pump for the evacuation of gas. Such a pulp pump is disclosed, for example, in Swedish Patent No. 467,466. The pipe usually includes a stop valve and a vacuum control means. Normally, flushing water is supplied to the pulp pump. The flushing water has the object of preventing clogging of the pipe to the vacuum pump and of diluting the pulp in the space behind the pulp impeller. The stop valve is controlled by a control valve for the pulp pump, so that the stop valve is opened at a predetermined setting of the control valve of the pulp pump. The vacuum control means is set so that at normal process conditions stable conditions are achieved.

Such a system has the disadvantage that a definite vacuum must be set in spite of the fact that the process conditions can vary. This implies, that an optimum vacuum cannot be maintained in each situation. As a consequence, the system in certain cases can permit pulp fibers to follow along with the gas through the pipe to the vacuum pump, which results both in fiber losses and in possible damage to the vacuum pump. A vacuum pump is constructed to pump gas, and fiber transfer constitutes a weakness, which reduces the reliability of the entire pulp pumping system. In other cases, the pulp pump can operate with much too great an amount of gas in the pump housing, which reduces the efficiency of the pump and causes so much gas to remain in the pulp that disturbances arise in subsequent process steps.

SUMMARY OF THE INVENTION

In accordance with the present invention, these and other problems have now been eliminated by the discovery of apparatus for pumping a pulp suspension containing a gas and for removing the gas from the pulp suspension, the apparatus comprising at least one pulp pump including a pump housing having an inlet for the pulp suspension, a first outlet for the pumped pulp suspension, and a second outlet for the gas, at least one external vacuum pump, a gas conduit for connecting the second outlet with the at least one external vacuum pump, the gas conduit comprising a substantially vertical portion having a maximum height located above the pulp pump, and flushing water supply means for supplying flushing water to the gas conduit, the flushing water supply means connected above the substantially vertical portion of the gas conduit. In a preferred embodiment, the apparatus includes a plurality of the gas conduits, a corresponding plurality of the pulp pumps and a plurality of the external vacuum pumps connected to the plurality of pulp pumps by the corresponding plurality of the gas conduits.

In accordance with one embodiment of the apparatus of the present invention, the apparatus includes a plurality of the pulp pumps, and a corresponding plurality of the gas conduits, and includes a common conduit connected to each of the plurality of gas conduits, and a plurality of the external vacuum pumps connected to the common conduit.

In accordance with another embodiment of the apparatus of the present invention, the maximum height of the substantially vertical portion of the gas conduit comprises at least a height corresponding to the atmospheric pressure plus a height corresponding to the pressure in the pulp pump inlet.

In accordance with another embodiment of the apparatus of the present invention, the apparatus includes vacuum control means for limiting the maximum vacuum in the apparatus.

In accordance with another embodiment of the apparatus of the present invention, the apparatus includes a plurality of stop valves located between each of the plurality of external vacuum pumps and the common conduit whereby each of the plurality of external vacuum pumps can be connected or disconnected from the common conduit.

In accordance with the present invention, these objects have thus been realized by the pulp pump being connected to an external vacuum by means of a pipe which is formed in a substantially vertical portion, the highest point of which is located at a level above the pulp pump, and upwardly in the vertical portion of the pump a means for supplying flushing water is connected.

The height of the substantially vertical portion of the pipe should be at least the height (measured as a water column), which corresponds to the atmospheric pressure, normally about 10 m, plus the height, which corresponds to the pressure in the inlet of the pulp pump. The supplied flushing water flows down through the pipe to the pulp pump. The pipe is only partially filled with water, so that the gas is permitted to pass upwardly, while the fibers follow along with the water back to the pulp pump. The water level in the pipe depends on the pressure in the pulp pump, the design of the pulp pump and the setting of the vacuum pump. The water level will vary automatically depending on the process conditions.

The present invention now provides for fiber losses to be avoided or be essentially reduced. An optimum vacuum can be obtained at different process conditions without the use of special control means. The stop valve for the vacuum pump as well as the vacuum control valve can be eliminated. The demand for flusing water can also be reduced by up to 80% due to the fact that no fibers are transferred to the driving liquid of the vacuum pump in the liquid ring. Used driving liquid can thereby be recycled as new driving liquid.

If for installational or other reasons it is not possible or desirable to achieve sufficient height of the pipe (see above), it can be necessary to control the vacuum system. The maximum vacuum must then be limited so that fibers do not follow along to the vacuum pump. This can be achieved by vacuum control in a suitable way which, for example, can give a signal when a maximum vacuum is exceeded.

According to one embodiment of the present invention, a pulp pump of the centrifugal pump type is coupled by means of a pipe to a vacuum pump located at a higher level. Alternatively, the vacuum pump can be placed on an optional level in relation to the pulp pump, if the pipe from the pulp pump first extends upwardly to the required level, and from there to the vacuum pump.

According to another embodiment of the present invention, two or more pulp pumps are coupled together to two or more vacuum pumps. All pulp pumps are placed at a lower level than the vacuum pumps. The vacuum pumps are connected to a common pipe of coarser (larger) dimensions. This coarser pipe is located above the pulp pump, and from it extends a smaller substantially vertical pipe down to each of the pulp pumps for de-airing according to the invention.

A means for supply of flushing water is connected to each of the smaller pipes. According to this embodiment, a stop valve can be placed between each vacuum pump and the coarser pipe in order to permit the switching-on and switching-off of the vacuum pumps after demand, both during operation and in connection with maintenance or repair without disturbing the operation and function of the pulp pumps. Also, the vacuum pumps can be placed on optional levels in relation to the pulp pumps, if the pipes from the pulp pumps first extend upwardly to the required level and from there to the vacuum pumps through the common coarser pipe.

BRIEF DESCRIPTION OF THE DRAWINGS

The present invention is described in greater detail in the following detailed description with reference to the Figures illustrating different embodiments of the present invention, as follows.

DETAILED DESCRIPTION

Figures 1, 2:
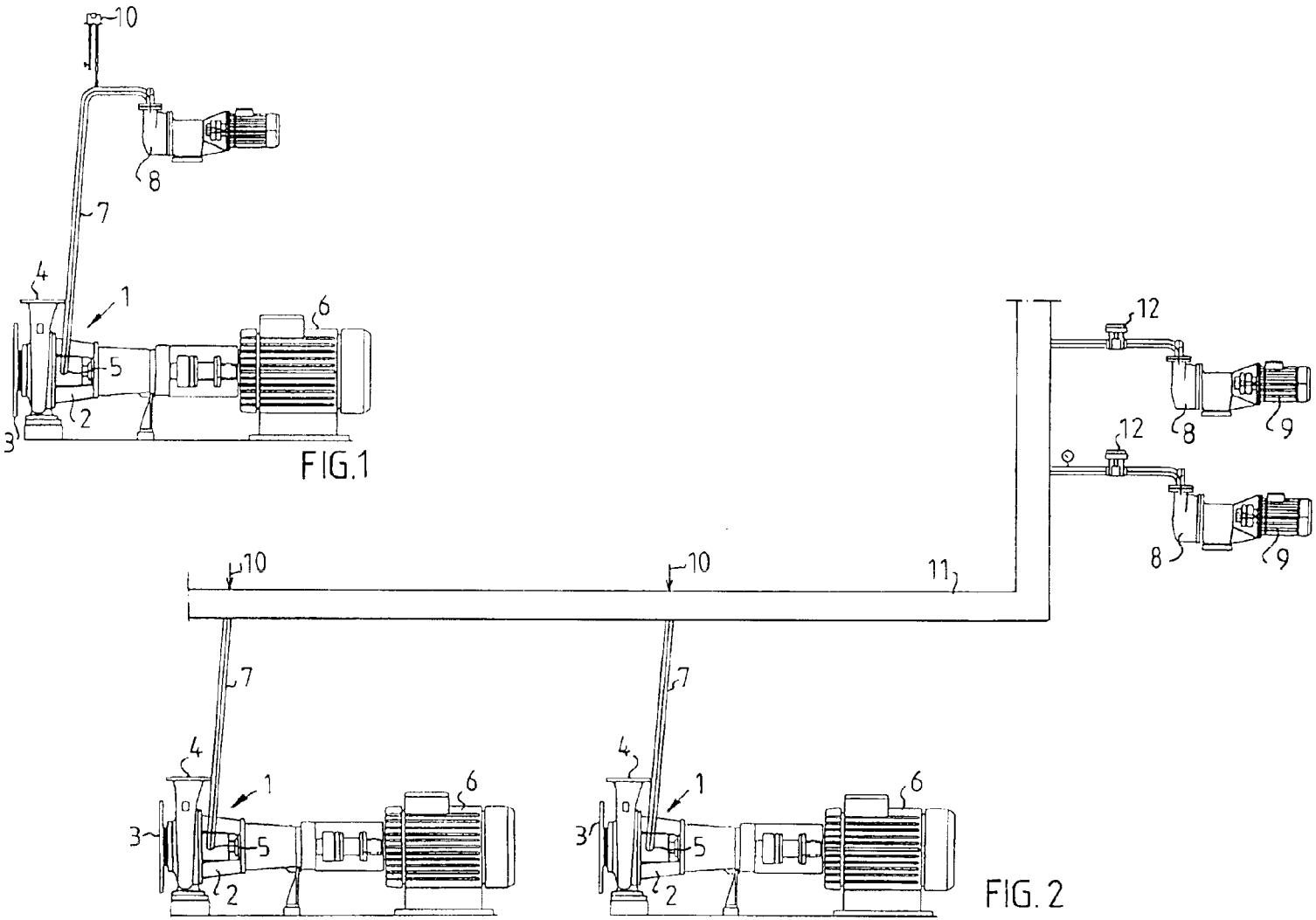
FIG. 1 is a side, elevational view of one embodiment of the apparatus of the present invention.
FIG. 2 is a side, elevational view of another rembodiment of the apparatus of the present invention.

FIG. 1 shows a pulp pump 1 in the form of a centrifugal pump, which is located at a first level. The pulp pump comprises a housing 2 with inlet 3 and outlet 4, respectively, for the pulp suspension and an outlet 5 for gas. The pump is driven by a motor 6. The housing 2 of the pulp pump is connected by means of a pipe 7 to a vacuum pump 8 in the form of a liquid ring pump with associated motor 9. The vacuum pump is located at a second level, which is higher than the first level. The pipe 7 has a substantially vertical portion, and a means 10 for the supply of flushing water to the pipe is connected above the vertical portion of the pipe.

FIG. 2 shows an installation with several pulp pumps and vacuum pumps of the type shown in FIG. 1. The same reference numerals as in FIG. 1 have been used. The pulp pumps 1 are located at a first level, and the vacuum pumps (8) at higher levels. The vacuum pumps 8 are connected to a common coarser pipe 11, which extends above the pulp pumps 1. A smaller substantially vertical pipe 7 extends from the coarser pipe 11 down to each pulp pump 1 for de-airing. A means 10 for the supply of flushing water is coupled to each pipe 7. Between each vacuum pump 8 and the coarser pipe 11 a stop valve 12 is inserted. In this manner, a vacuum pump can be disconnected for service, repair, exchange or the like without requiring a pulp pump to be cut off. It is also possible to reduce the number of vacuum pumps, because every pulp pump does not need a vacuum pump of its own.

Upon starting the installation, one vacuum pump 8 can suitably be taken into operation, while the other vacuum pumps are idling, i.e. the associated stop valves 12 are closed. With an increasing amount of gas the pressure increases, i.e. the capacity of the vacuum pump is not sufficient. When a predetermined pressure has been reached, additionally one vacuum pump is coupled-in by opening the associated stop valve 12, and so forth.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

What is claimed is:

1. Apparatus for pumping a pulp suspension containing a gas and for removing said gas from said pulp suspension, said apparatus comprising at least one pulp pump including a pump housing having an inlet for said pulp suspension, a first outlet for said pumped pulp suspension, and a second outlet for said gas, at least one external vacuum pump, a gas conduit for connecting said second outlet with said at least one external vacuum pump, said gas conduit comprising a substantially vertical portion having a maximum height located above said pulp pump, and flushing water supply means for supplying flushing water to said gas conduit, said flushing water supply means connected above said substantially vertical portion of said gas conduit.

2. The apparatus of claim 1 including a plurality of said gas conduits, a corresponding plurality of said pulp pumps and a plurality of said external vacuum pumps connected to said plurality of pulp pumps by said corresponding plurality of said gas conduits.

3. The apparatus of claim 1 including a plurality of said pulp pumps, and a corresponding plurality of said gas conduits, and including a common conduit connected to each of said plurality of gas conduits, and a plurality of said external vacuum pumps connected to said common conduit.

4. The apparatus of claim 3 wherein said common conduit is larger than said plurality of gas conduits.

5. The apparatus of claim 1 wherein said maximum height of said substantially vertical portion of said gas conduit comprises at least a height corresponding to the atmospheric pressure plus a height corresponding to the pressure in said pulp pump inlet.

6. The apparatus of claim 1 including vacuum control means for limiting the maximum vacuum in said apparatus.

7. The apparatus of claim 3 including a plurality of stop valves located between each of said plurality of external vacuum pumps and said common conduit whereby each of said plurality of external vacuum pumps can be connected or disconnected from said common conduit.

* * * * *